United States Patent [19]

Stanislawski

[11] Patent Number: 4,719,898

[45] Date of Patent: Jan. 19, 1988

[54] INSTANT OUTDOOR COOK GRILL

[76] Inventor: Robert E. Stanislawski, 639 Clarks La., Winona, Minn. 55987

[21] Appl. No.: 806,175

[22] Filed: Nov. 22, 1985

[51] Int. Cl.[4] ..... F24C 1/16

[52] U.S. Cl. ..... 126/9 R; 126/30

[58] Field of Search ..... 126/30, 9 R, 9 B, 25 A, 126/29

[56] References Cited

U.S. PATENT DOCUMENTS 3,395,692 8/1968 Johns ..... 126/30

4,120,279 10/1978 White ..... 126/30

4,531,505 7/1985 Hait et al. ..... 126/9 R 4,548,193 10/1985 Marogil ..... 126/30

*Primary Examiner*—Carroll B. Dority, Jr.

[57] ABSTRACT

Fully adjustable, sturdy, stable, and portable outdoor cook grill that sets up instantly for cooking over an open fire; and includes a lower post section, and a self folding grill unit assembly. The grill unit assembly consists of: a grill, permanently hinged to one end of a rigid hanger, and joined permanently to the hanger's other end by two support lines; all assembled onto an upper post section. All fits cleanly inside a compact carrying/-transport/storage/shipping container.

7 Claims, 6 Drawing Figures

INSTANT OUTDOOR COOK GRILL

BACKGROUND OF THE INVENTION

1. Field of the Invention

This invention relates generally to camping or backyard barbecue equipment, and more specifically, pertains to a new grill that sets up instantly and protects cleanliness of storage surroundings.

2. Description of the Prior Art

Numerous means have been proposed for use in outdoor cooking. Individually they all have advantages; but none, so far as I am aware, meet the collective objectives as does the present invention. All require the attention of both hands of the operator to enact horizontal/vertical repositioning relative to the heat source by disengaging/reengaging some form of screw or hooking device. This has obvious disadvantages if the operator's second hand is ocuppied at the time. These engagement locks are usually located unnecessarily near the proximity of the heat source aggravating a potential burn hazard to the operator. Furthermore, prior art monopod types are prone to jamming up on their support post during vertical adjustment due to poor alignment, or in other cases, to burrs developing from repeated uses of locking/set screws. All require an unnecessary amount of effort to disassemble/reassemble in the use/storage cycle. None illustrate any means to transport and store the unit between uses, or do they give attention to cleanliness. All prior arts are unnecessarily uneconomical to manufacture.

These disadvantages of the prior art are evident in the U.S. Pat. No. 4,269,164 to Van Grinsven et al., which discloses elaborate quantity and kinds of component parts. The Van Grinsven et al. rigid element 19, though vague in detail, appears to require disassembly between uses, and two hands to operate to prevent binding to the vertical post during vertical repositioning.

Likewise, the U.S. Pat. No. 4,120,279 to White requires excessive attention to vertical repositioning to avoid total collapse midstream and requires two hand operation, and disassembly for transport/storage between uses.

None of the adjustable prior arts provide for tactile detenting to numerous horizontal positions, or do they self-fold flat and compact.

SUMMARY OF THE INVENTION

Intense public interest in the need and use of the present invention is generally known and even more apparent from the numerous patents granted to date that address this pubic need. So far as I am aware, there has not been a device as basic in content, yet so complete in fulfilling this public need wholly in one assembled unit, as is the present invention.

The present invention consists of a post, with multiple protrusions, a single piece hanger, two suspension lines, and grill surface; for use in suspending matter at a fixed position elevated above the ground, as in barbecueing outside over a fire for example. The present invention has a reduced number of parts and these parts are designed for manufacturability resulting in overall economic advantages over all prior arts.

Control of cooking temperature is basic to grilling over an open fire. This can be achieved by varying the position of the cook grill relative to the fire. Secondary to this are many convenience objectives inherent in the present invention which provides combined and complete conveniences to the user, wholly in one basic unit. These convenience objectives are now listed for the present invention:

1. It is lightweight and requires no disassembly/reassembly to self-fold flat and compact inside the supplied reusable transport/storage/shipping container which keeps storage surroundings clean of the soot and grime inherent with grilling. This automatic self folding principle is achieved by a hinge joint joining the grill and hanger, working in conjunction with the suspension lines. To set up, one needs only to remove the present invention from the container, by holding it by its top end, to have it instantly self-fold open and ready for use. This is an improvement to portability, storage, and ease of use over the prior arts.

2. Vertical and horizontal readjustments of the grill position relative to the fire is executed easily with only one hand applied to the handle. This is due to an improved quality of design of the hanger-to-post bearing. This design eliminates the binding and galling evident with the prior arts. The handle is placed, by design, at a point remote from the heat source to reduce the risk of burns to the operator. No sacrifice is made to limit the basic requirement for full range vertical and horizontal readjustment. This full range of readjustment of position is the motivating force behind the present invention compared to U.S. Pat. No. 4,120,280 to Iverson et al. unit, which has only vertical adjustment capability for position relative to the fire. Horizontal adjustment to off and away from the fire is especially handy when turning the food while the fire is hot, or to effect slight rotisserie changes to cooking temperature.

3. The present invention is strong and rigid. Stability of vertical and horizontal position, once selected, is provided for by the post protrusions, and indents to the under side of the hanger's bearing rings, respectively. These indents further aid in preventing "flying-by" the horizontal position sought after, and provide stability to horizontal rotisserie position.

4. By utilizing parts designed with light weight materials having large surface area-to-volume ratios the handle stays cool and cool down time is rapid once the unit is removed from the heat source.

5. Positive end stops for torsional travel of the hanger/grill/suspension lines assembly provides a safety means of preventing the grill surface from accidentally "falling off the edge of the world".

6. The present invention is preassembled and remains assembled throughout its applied life with exception of the post, whose lower end separates to fit inside a reuseable carrying container. This container nicely provides for keeping storage surroundings clean as well!

The present invention provides over-all improvement over all the prior arts in complexity, reliability, quality, and convenience. This will be seen by the detailed understanding offered in the PREFERRED EMBODIMENTS and MODE OF OPERATION.

BRIEF DESCRIPTION OF THE DRAWINGS

Other objects and many of the attendant advantages of this invention will be readily appreciated as the same becomes better understood by reference to the following detailed description when considered in connection with accompanying drawings, in which like reference numerals designate like parts throughout the figures and wherein.

DESCRIPTION OF THE PREFERRED EMBODIMENTS

Figure 1:
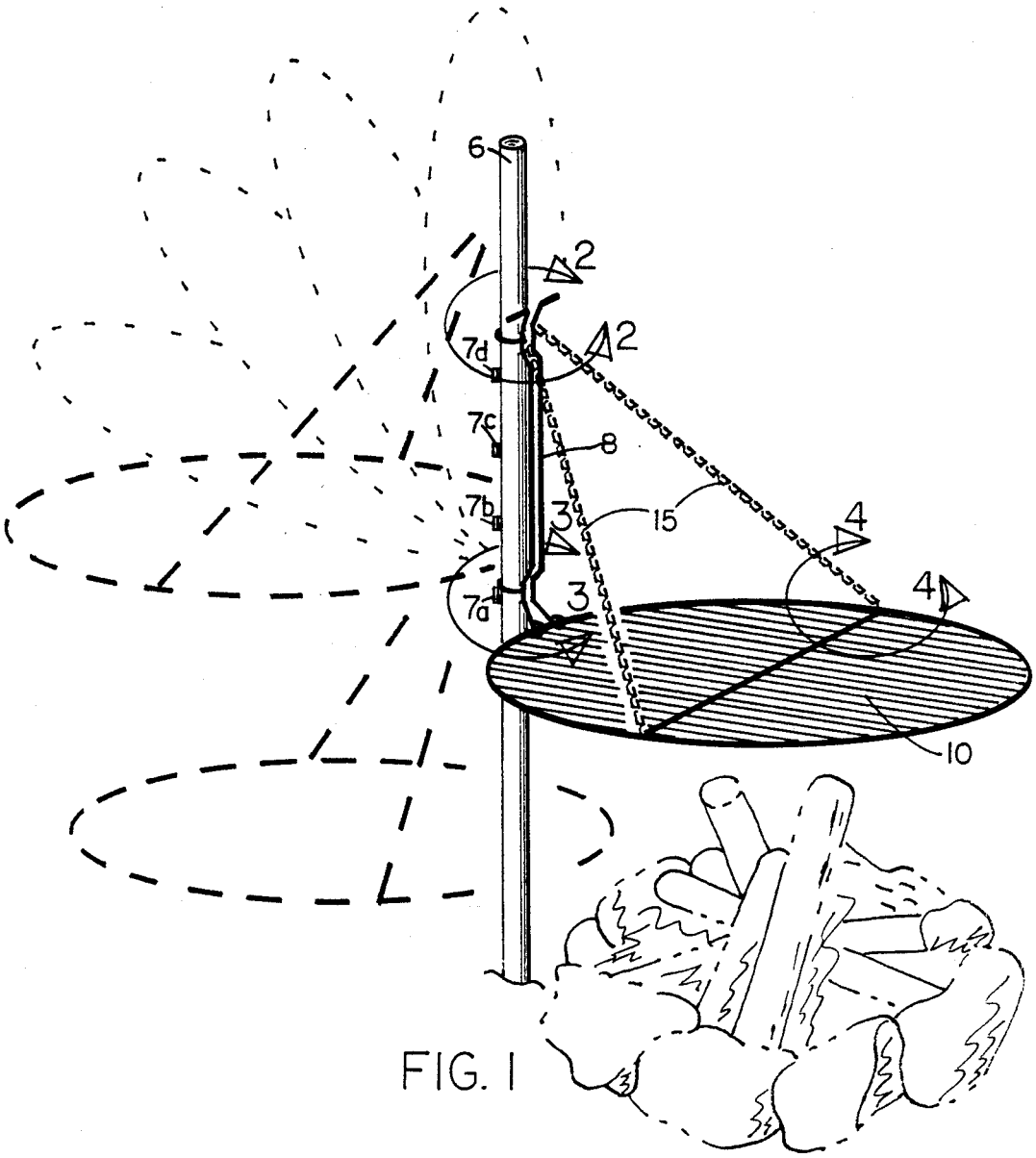
FIG. 1 is a vertical elevation perspective view of an instant outdoor cook grill provided in accordance with the present invention for use outdoors.

FIG. 1 shows, in solid lines, the present invention set up over a campfire. The campfire is shown in hashed lines. Shown in bold-broken lines are two examples, of the many possible horizontal and vertical adjustment positions the present invention can be set or adjusted to, relative to the fire. Shown in light-broken lines is the present invention's automatic self folding action eliminating the need for disassembly and reassembly for transport/storage between uses.

Figure 2:
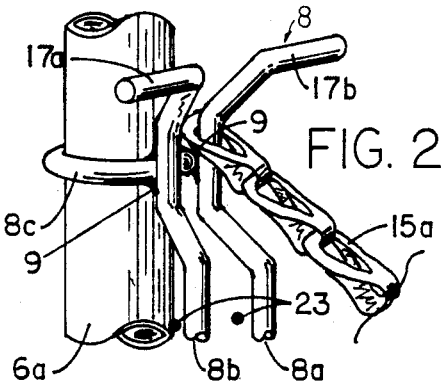
FIG. 2 is a full scale fragmentary perspective view taken within the line 2—2 of FIG. 1 with one suspension line 15*a* ommitted for clarity.
Figure 4:
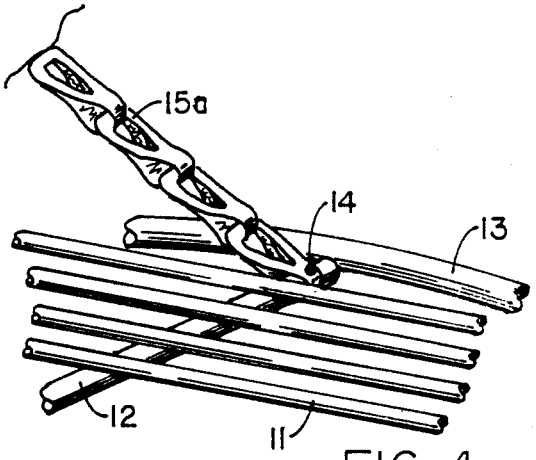
FIG. 4 is another similar view taken within the line 4—4 of FIG. 1, and FIGS. 2, 3, and 4 are arranged in relative position to one another.
Figure 3:
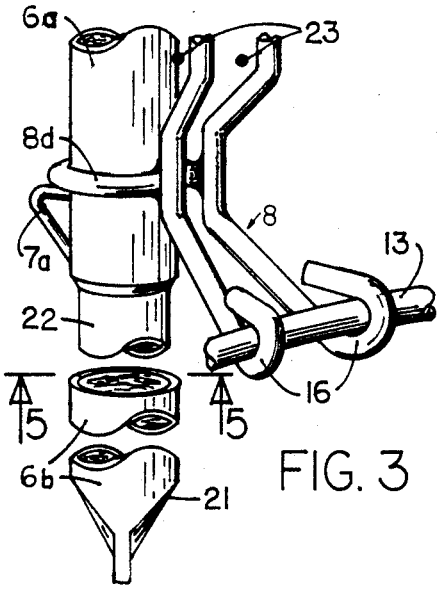
FIG. 3 is a similar view taken within the line 3—3 of FIG. 1.

FIGS. 2, 3 and 4 are arranged so as to illustrate their relative position to one another.

FIG. 2 illustrates a hook-over interface of suspension line 15*a* to the hanger 08 and a clearance-diametrical-slip-fit of hanger 08 to vertical post 06 allowing the hanger to slide and rotate freely on the post. The hanger 08 is a one piece rigid member including two rigid stringers 8*a* and 8*b* joined permanently together with the two rigid bearings 8*c* and 8*d* at four points 09, as by resistance welding. The Stringers have tabs 17*a* and 17*b* at their upper ends for attaching the suspension lines 15. The tabs act as a handle to aid in one handed operation during vertical repositioning and is located distant from the heat source to be as cool as possible. The second suspension line is removed for clarity. Points 23 along side stringers 8*a* and 8*b* depict the clearance necessary to clear the protrusions 07 during vertical repositioning detailed under MODE OF OPERATION.

FIG. 3 illustrates several interfaces a hinge interface 16 of grill 10 to hanger 08; a clearance-diametrical-slip-fit of hanger 08 to vertical post 06; a reduced diameter end 22 on vertical post section 6*a* to slip fit snug into the inside diameter of vertical post section 6*b;* and a bearing 8*d* interface at rest atop protrusion 7*a,* one of several such protrusions joined permanently to the exterior wall of the vertical post 06 by such means as may be convenient to manufacture such as by welding, pinning, or forming, etc.. One end 21, of the vertical support 06 is spade flattened to ease entry into the ground and prevent torsional movement once driven into the ground. The in line protrusions 7*a, b, c,* . . . each provide a shelf, extended rigid outward from the vertical post, to support the load weight of the grill and hanger assembly and contents, via either hanger bearing 8*c,* or 8*d,* at rest atop one protrusion. Note the spacing of the hanger bearings equals a half-integer multiple of the protrusion spacing. This provides for vertical position resolution equal one half the spacing of the protrusions in the center of the vertical adjustment range and full resolution at the outer ends of the range.

FIG. 4 illustrates at point 14, one of two required "direct interface" means of the suspension lines 15 to the grill 10. The center rib wire 12 is spaced with a slight end-gap to the perimeter wire 13 large enough to assemble end 14 of the suspension line 15, yet small enough to not permit this end 14 to self-disassemble from the grill's center wire 12.

Figure 5:
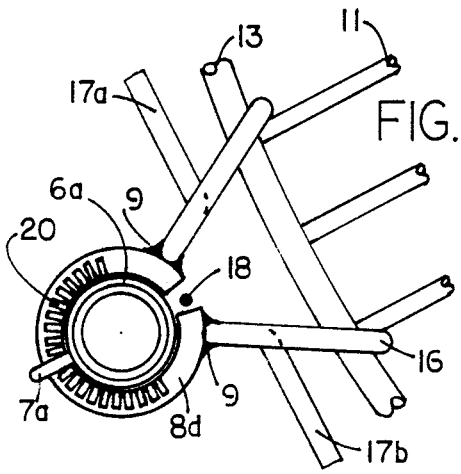
FIG. 5 is an full scale fragmentary, bottom plan view taken from the vantage point of line 5—5 of FIG. 3; and, FIG. 6 is a vertical reduced elevation perspective view of a reuseable carrying/transport/shipping/storage container enveloping structure provided in accordance with the present invention.

FIG. 5 illustrates numerous indents 20 around part or all of the under surface of both hanger ring bearings 8*c,* and 8*d,* that ride, individually, atop a selected protrusion 7*a, b, c,* or . . . . This provides a tactile or "detent bearing action" means to the mechanism to maintain a horizontal position once selected and also prevents flying-by a desired fine adjustment position to the horizontal. Also shown is the opening 18, which is part of both hanger ring bearings 8*c* and 8*d,* and provides clearance through which to pass over protrusions 07 during vertical repositioning proceedings. Note FIG. 5 is not shaded, this is to emphasize that it is an auxillary view from the bottom and not a perspective view.

Figure 6:
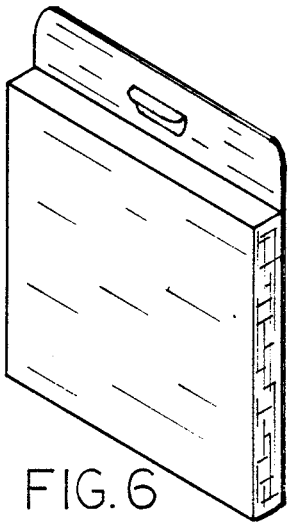

FIG. 6 illustrates a reuseable carrying/transport/-storage/shipping enveloping structure fitted in size to the diameter of grill 10 to contain the present invention compact and completely assembled inside, except for the lower vertical post 6*b,* which is a separate piece that also fits inside the enveloping structure thereby keeping storage surroundings clean.

DESCRIPTION OF ALTERNATIVE EMBODIMENTS

The suspension lines could be rigid and still the present invention could fold by an unlatch-and-slide-through principle that could be located at its junction point to the grill.

Or the suspension lines could be rigid and support by compression from below instead of by tension from above. This would require the interfaces illustrated in FIG. 2 to relocate below the grill instead of above as shown in the preferred embodiments.

The post section's male, female, sequence of fitting together could be a female, male, sequence as well.

Hanger 08 could be a single rigid piece stamped and formed from sheet metal instead of a welded wire form, or a combination of wire and sheet metal.

A screw pin or an interference dimple could be added at point 22/FIG. 3 of the upper and lower vertical pipes 6*b* and 6*a* to lock them together.

MODE OF OPERATION

The present invention operates in five modes: set-up, vertical repositioning, horizontal repositioning, static, and teardown. To understand these modes, it is important to understand the mechanics of the suspension principle. The suspension principle involves multiple protrusions, fixed permanently to the exterior of the vertical post, acting as ledges on which to support the weight of the hanger and grill assembly with its cooking load contents, via either of the hanger's bearings 8*c,* or 8*d.* Either of the hanger's two bearings can rest atop any one given protrusion providing numerous vertical position selections. The hanger remains guided by its two bearings on the outside diameter of the vertical post, forcing the hanger to remain always vertical as it slides and rotates on the post. The grill subsequently suspends horizontal off the hanger by two suspension lines and the grill/hanger hinge junction.

The set-up mode consists of removing the "grill assembly", parts *6b*, 8, 15, and 10 assembled altogether, and lower post from the transport/storage container, pounding the lower post vertical into the ground, and inserting the "grill assembly" into the top of the lower post. The present invention is then ready for use.

The vertical repositioning mode consists of repositioning the grill assembly, parts 8, 15, and 10 assembled altogether, from at rest atop the current protrusion to atop another. This is done by executing a "lift/twist/-set-down" action detailed in the following successive steps:

1. Rotate the grill assembly horizontally until either stringer 8*a* or 8*b* abuts one of the protrusions 07.
2. Lift the grill assembly slightly, in order to the stringers to horizontally clear the protrusions, and rotate until opening 18 is aligned to pass by the protrusion(s) 07.
3. Lift or lower the grill assembly to the new vertical position.
4. Rotate slightly to re-engage the hanger bearing down to rest atop the new protrusion.

Note, the actual vertical repositioning is much easier than reading/writing the procedure for same.

The horizontal repositioning mode consists of moving the grill assembly, parts 8, 15, and 10, by applying a slight lateral force to the grill 10 or handle 17 to move it to the new position.

The teardown mode consists of packing up the grill for transport. This involves removing the unit from the heat source, letting it cool, separating the lower post from the rest of the assembly and putting it all inside the transport/storage container.

In view of the many possible variations to manufacture of the present invention in the choice of materials, colors, shapes, etc., it is the intent of the appended claims to cover all such variations falling within the true spirit and scope of the present invention; and

I claim:

1. A portable, horizontally and vertically adjustable, and foldable grill comprising:

a. a vertical post, including a plurality of spaced shelf protrusions in line and permanently fixed along a longitudinal line of said post; and b. a grill surface having a perimeter rim wire and, c. a first and a second flexible suspension member; and d. a hanger support for hinge joining said grill surface and said first and second flexible suspension members engaged to said vertical post, and all said elements together composing a unit-assembled-apparatus with a non-seizing positioning means for suspending said grill surface horizontal in a vast multitude of rigid positions high, low, and sideways for suspending food for cooking over and away from a heat source and said unit-assembled-mechanism having a self-folding means for folding fully assembled into a flat package for clean compact storage. transport, and shipping and providing instant set-up between uses, said hanger support comprising:

first and second rigid bearing ring members held sufficiently far apart and exteriorly joined in line on their common bearing ring axis by permanent fixed attachment at four points of joining adjacent to the ends of two sufficiently long rigid stringer members, said first and second rigid bearing ring members being adapted for simultaneous complete pivotal engagement over said vertical post and individual thrust engagement on top of any one of said shelf protrusions, and each said rigid bearing ring member having sufficient opening in its' minor arc of said joining with said stringers to allow clear passage of said shelf protrusions through said openings, and the portion of first and second said stringer members intermediate first and second said bearing ring members formed sufficiently radially distant from said common bearing ring axis for said stringer members to radially clear the ends of said shelf protrusions during pivotal travel of said hanger support engaged about said vertical post, each said stringer member terminating in a loop at one first end common to first said bearing ring member, first and second said loop of first and second said stringer members comprising together a hinge means for hinge joining over the perimeter rim wire of said grill, the second end of first and second said stringer members each extending upward beyond said points of joining at said second rigid bearing ring thereat providing first and second tabs for attachment of top ends of said first and second flexible suspension members to said first and second tab members and the bottom ends of said first and second flexible suspension members permanently assembled to opposing ends of a diametrical rib of said grill surface to suspend said grill surface substantially horizontal to said vertical post, whereby said hinge means in conjunction with the flexible nature of said suspension members provide said self-folding means for said grill in said unit-assembled-apparatus to fold flat against said vertical post for compact storage without disassembly.

2. A grill as in claim 1 wherein the portion of said hanger support first and second said stringer members locally adjacent to first and second said bearing ring members are formed and shaped sufficiently radially near said bearing ring axis to provide an interference stop with said shelf protusion when any said bearing ring rides thrust engaged on top of any said shelf protrusion during pivotal travel of said hanger support whereby unintentional dropping of vertical position during usage is prevented without a prior intentional lift and align of said ring openings with said shelf protrusion.

3. A grill as in claim 1 wherein said first and second tab members of said hanger support are formed in line outward to said stringer members to provide a direct handle means to position said grill surface horizontally and vertically conveniently with a single hand.

4. A grill as in claim 1 wherein indents are formed into the underface of said first and said second bearing ring members of said hanger support to interface said shelf protrusions to provide freely selectable yet stable fine-adjustment to horizontal positioning of said grill surface relative to said vertical post.

5. A grill as in claim 1 wherein said vertical post breaks apart and parts are formed and sized to reinsert together by interference fit to prevent unintentional motion one relative the other, the end of one of said parts spade formed to ease entry into the ground.

6. A grill as in claim 1 in combination with a one piece enveloping structure having a handle opening and is shaped and sized flat to a minimum thickness to completely surround said grill device folded inside, providing a convenient means of carrying.

7. A hanger support for a grill surface comprising: first and second side by side elongated rigid stringer members, a ring bearing member fastened to each stringer member adjacent one corresponding end and a ring bearing member fastened to each stringer member adjacent another corresponding end, each ring bearing member having a space between adjacent stringers, the lower ends of said stringer members being bent about a wire of said grill to form a hinge upper ends of said stringers being bent to form tabs, flexible suspension members connected to the upper ends of said stringers and to said grill.

* * * * *